United States Patent [19]

Sando et al.

[11] Patent Number: 4,495,783

[45] Date of Patent: Jan. 29, 1985

[54] APPARATUS FOR CONTINUOUS WET-HEAT TREATMENT OF CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 530,125

[22] Filed: Sep. 7, 1983

[30] Foreign Application Priority Data

Sep. 16, 1982 [JP] Japan ..... 57-161399
Sep. 16, 1982 [JP] Japan ..... 57-161400
Sep. 16, 1982 [JP] Japan ..... 57-161401

[51] Int. Cl.[3] ..... D06B 3/12; D06B 23/20
[52] U.S. Cl. ..... 68/5 D; 68/202
[58] Field of Search ..... 68/5 D, 5 E, 43, 202; 165/140

[56] References Cited

U.S. PATENT DOCUMENTS 2,628,884 2/1953 Jacoby ..... 68/5 D X
3,066,518 12/1962 Fujihashi ..... 68/5 E
3,447,346 6/1969 Norton ..... 68/5 D
3,585,696 6/1971 Aronoff ..... 68/5 D
3,603,119 9/1971 Kawaguchi ..... 68/5 D

FOREIGN PATENT DOCUMENTS 779149 7/1957 United Kingdom ..... 5 D/
2075073 11/1981 United Kingdom ..... 68/5 E

*Primary Examiner*—Philip R. Coe
*Assistant Examiner*—Frankie L. Stinson
*Attorney, Agent, or Firm*—Wenderoth, Lind & Ponack

[57] ABSTRACT

A method for continuous wet-heat treatment of a cloth, comprising applying a treating liquid such as a treating solution and/or water superheated to a temperature higher than 100° C., which is oozing out of a plurality of liquid applying rollers, to a cloth running continuously through a non-tightly sealed wet-heat treating chamber for soaking the cloth with the treating liquid up to the core part thereof with the use of a limited amount of the liquid, the said liquid applying rollers being provided with numerous irregular, curved and bent communicating pores all over its periphery; and an apparatus therefor.

3 Claims, 5 Drawing Figures

APPARATUS FOR CONTINUOUS WET-HEAT TREATMENT OF CLOTH

BACKGROUND OF THE INVENTION

The present invention relates to an apparatus for continuous wet-heat treatment of a cloth, in which a long cloth can be wet-heat treated eminently.

In subjecting a long cloth produced commercially to such treatments as scouring, bleaching, weight reduction, dyeing and resin finish under wet-heat continuously, it is conventional to use a high pressure steamer as a wet-heat treating chamber. Usually, a cloth to be treated is soaked with a treating solution in a treating solution tank provided outside of the steamer body, an excess of the treating solution absorbed in the cloth is squeezed with the use of a pair of squeeze rollers, the cloth is dried immediately for preventing the adhesion of the treating solution absorbed in the cloth to the seal rollers and to the guide rollers in the subsequent steps in the steamer body, and finally the resultant cloth is steamed in the steamer body for the treatment of the cloth with the treating solution.

However, in such a conventional wet-heat treating method, since the steamer body must be maintained with a high temperature and humidity atmosphere prior to the wet-heat treatment of a cloth, it requires a long time until the interior of the steamer body is heated to a prescribed high temperature and humidity condition to prolong a preparatory time for the treatment, and further a large quantity of heat energy must be consumed until the interior of the steamer body is made into a prescribed high temperature and humidity atmosphere.

In the case when a pair of seal mechanisms are provided at the cloth inlet and outlet of the steamer body for maintaining the interior of the steamer body with a high temperature and humidity atmosphere under pressure while allowing the taking in and out of a cloth continuously through the steamer body, a construction of the whole apparatus becomes complicated, and particularly, in a large size apparatus for practical use, the construction cost becomes unavoidably very high.

Moreover, in the conventional wet-heat treating method of a cloth, while the cloth soaked with a treating solution must be squeezed with the use of a pair of squeeze rollers for removing the excess of the treating solution absorbed in the cloth as mentioned above, the problem of unevenness is unavoidable in squeezing. That is to say, the width of a commercial cloth is at least 90 cm, and it requires a squeeze roller with a length at least the same as the width of the cloth, say at least 90 cm, for squeezing such a wide cloth continuously. With such a long squeeze roller, however, the squeezing pressure unavoidably differs between the central part and both end parts of the roller, causing unevenness in squeezing the treating solution from the cloth and consequently unevenness in the treatment. In dyeing, particularly, the occurrence of dyeing speck due to the unevenness in squeezing is a serious problem.

SUMMARY OF THE INVENTION

Under such circumstances, the principal object of the present invention is to offer an apparatus for continuous wet-heat treatment of a cloth by eliminating the drawbacks as mentioned above.

The principle of the method for using the apparatus comprises applying a superheated liquid such as a hot treating solution and/or hot water (hereinafter will be called a treating liquid) at a temperature higher than 100° C. to a cloth running continuously through the wet-heat treating chamber by contacting the cloth with the superheated treating liquid oozing out of a plurality of liquid applying rollers for soaking the cloth with the treating liquid up to the core part thereof uniformly and effectively with the consumption of a limited amount of the treating liquid in a non-tightly sealed wet-heat treating chamber of the cloth. It is desirable that the cloth soaked with a treating solution is further heated in the wet-heat treating chamber, particularly with the use of far infrared burners.

The apparatus therefor comprises a non-tightly sealed wet-heat treating chamber provided with a plurality of guide rollers for transporting a cloth to be treated continuously through the chamber and a plurality of liquid applying rollers for applying a treating liquid to the said cloth, said liquid applying rollers being provided with numerous irregular, curved and bent communicating pores allover their periphery for passing the treating liquid therethrough, and a high temperature liquid generating mechanism, which is provided with a treating liquid heating pipe and/or water heating pipe communicating to the liquid applying rollers in the wet-heat treating chamber and maintained with high temperature and pressure steam by supplying superheated steam thereto, for supplying a superheated treating liquid to the cloth in the wet-heat treating chamber.

The continuous wet-heat treatment of a long cloth can be done effectively with no need of squeezing the cloth after the cloth is soaked with a treating liquid, thus dissolving the problem of the loss of treating liquid, and with no need of applying a tightly sealed high pressure steamer with a complicated structure as a wet-heat treating chamber. The present inventive apparatus is simple in its structure and can spare the wasteful loss of heat energy. Thus, the present invention is to offer an excellent method and apparatus for continuous high temperature wet-heat treatment of a cloth.

DETAILED DESCRIPTION OF THE PREFERRED EMBODIMENTS

Preferred embodiments of the present invention will be described in detail in the following with reference to the examples of the inventive apparatus.

EXAMPLE 1

Figure 1:
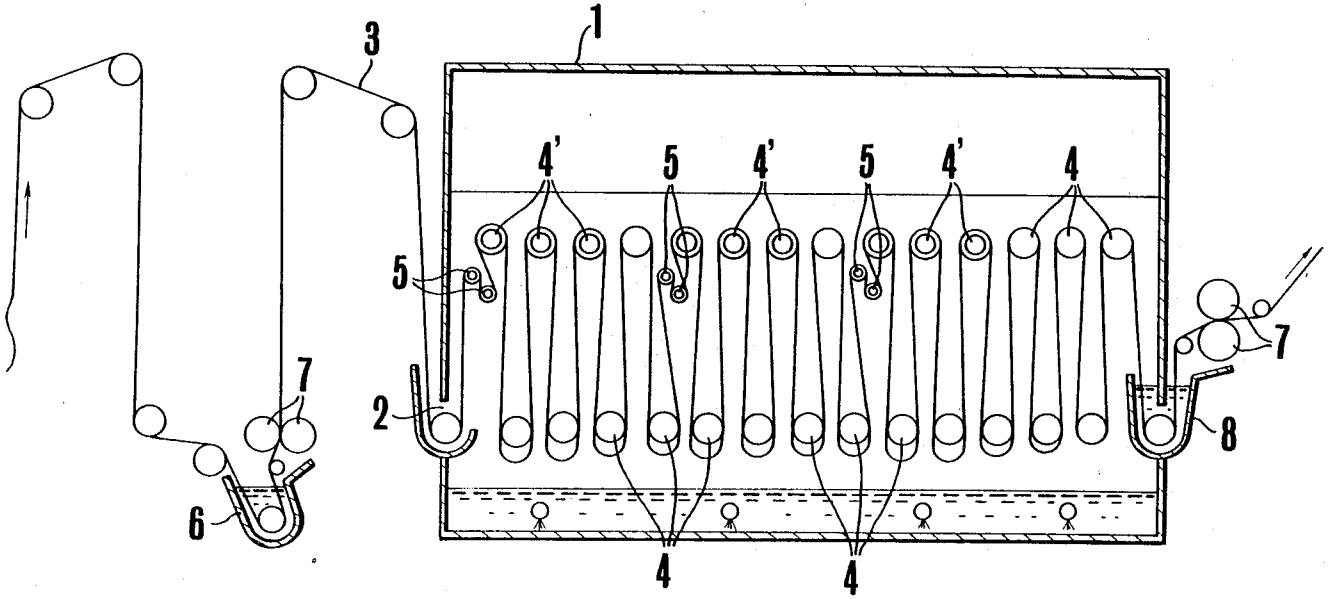
FIG. 1 is a sectional side view of an example of the wet-heat treating chamber in the present invention.

The wet-heat treating chamber in this example of the present inventive apparatus is as shown in FIG. 1. In the figure, 1 is a non-tightly sealed chamber for continuous wet-heat treatment of a cloth. In the chamber 1, 4 are a plurality of guide rollers provided up and down in two stages for transporting a long cloth to be treated 3 zigzag forming snaky undulations under no tension through the wet-heat treating chamber 1. A part or total of the guide rollers at the upper stage are substituted in this example with open width rollers 4' for preventing the formation of creases of the cloth. 5 are cylindrical liquid applying rollers for applying a prescribed superheated treating liquid (a treating solution or water) to the cloth passing zigzag through the web-heat treating chamber 1 intermittently and repeatedly. In this example, the liquid applying rollers 5 comprise a plurality of roller pairs for applying a treating liquid to both sides of the cloth simultaneously, but the liquid applying rollers may be with one roller each for applying the hot liquid to only one side of the cloth.

6 is a liquid tank provided at the front side outside of the wet-heat treating chamber 1 for soaking the cloth with a prescribed treating liquid before the cloth is supplied into the wet-heat treating chamber. It is designed so that the cloth is then transported into the wet-heat treating chamber for the steaming thereof. 2 is a cloth inlet to the wet-heat treating chamber 1. 7 are squeeze rollers and 8 is a liquid seal tank provided at the outlet of the wet-heat treating chamber 1.

Figure 2:
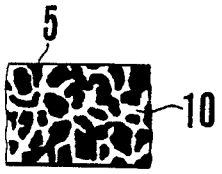
FIG. 2 shows an enlarged sectional view of a part of a liquid applying roller.

FIG. 2 is to show an enlarged sectional view of a part of the liquid applying roller 5. The liquid applying roller 5 is cylindrically formed with a foam metal having permeability to liquid. As shown in the figure, the foam metal is composed of numerous irregular, curved and bent communicating pores 10 (for instance, 10 to 30 pores/cm$^2$) allover its periphery. The size of the communicating pores 10 is preferably changed according to the viscosity of the liquid to be applied and the amount of the liquid to be applied to the cloth so as to apply a necessary and sufficient amount of treating liquid to the cloth with no loss. It is desirable for this purpose to prepare many kinds of foam metals having different pore sizes previously. The liquid applying pipes 5 are communicating to a treating liquid heating pipe or a water heating pipe in a high temperature liquid generating mechanism 11 shown in FIG. 3.

Figure 3:
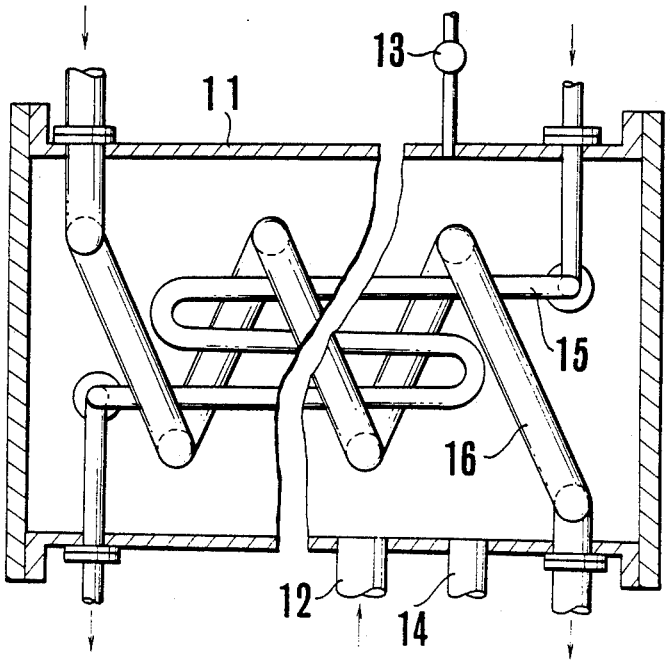
FIG. 3 is a sectional side view of a high temperature liquid generating mechanism.

A high temperature liquid generating mechanism 11 in the present invention comprises, as shown in FIG. 3, a steam supplying pipe 12 for supplying high temperature and pressure steam into the mechanism 11, an inner pressure automatic control valve 13 for maintaining the interior of the mechanism 11 with steam at a constant temperature, a waste liquor discharge valve 14 to be used at need, a treating liquid heating pipe 15 arranged zigzag in the mechanism, and a water heating pipe 16 arranged similarly as in the treating liquid heating pipe 15. The treating liquid heating pipe 15 and the water heating pipe 16 (hereinafter will be called the treating liquid heating pipes) are arranged so that a treating liquid and water coming from outside of the high temperature liquid generating mechanism 11 are heated in the mechanism and supplied to the liquid applying rollers 5 in the wet-heat treating chamber 1. For the use in Example 1 of the apparatus, the treating liquid heating pipe 15 may be dispensed with. The construction of the treating liquid heating pipe 15 and the water heating pipe 16 is not limited to the ones shown in FIG. 2. Their construction may be optional so long as they can easily receive the heat in the high temperature liquid generating mechanism 11. It is desirable to provide a plurality of wings to the heating pipes for elevating the efficiency of heat exchange.

The construction of Example 1 of the present inventive apparatus is as described above. Now, the wet-heat treatment of a cloth continuously with the use of this apparatus will be stated in the following.

At first, superheated steam is supplied from the steam supplying pipe 12 into the high temperature liquid generating mechanism 11 for maintaining the interior of the mechanism 11 with high pressure steam at a temperature about 150° C. and a pressure about 5 kg/cm$^2$, and the treating liquid heating pipe 15 and the water heating pipe 16 are heated nearly to this temperature. By passing water in the pipe 16, in this instance, water can be also heated to about 150° C. Thus heated water is sent under pressure to the liquid applying rollers 5. On the other hand, a cloth to be treated 3 is soaked with a treating liquid in the liquid tank 6 and transported continuously through the wet-heat treating chamber 1.

In the wet-heat treating chamber 1, water or a treating liquid supplied into the liquid applying rollers 5 oozes out of the roller by passing through numerous irregular, curved and bent pores 10 to the surface thereof, and is applied repeatedly to the cloth 3 running in contact with the liquid applying rollers 5 through the wet-heat treating chamber 1 continuously. Therefore, the cloth is soaked with a necessary and sufficient amount of the treating liquid, and in prescribing the sufficient amount of the treating liquid previously, the treating liquid can totally be utilized with no loss. It is desirable to apply a suitable pressure for passing the treating liquid through the irregular, curved and bent pores 10 of the liquid applying rollers 5. The application of pressure is effective to ooze out of the treating liquid from allover the liquid applying rollers (which must be longer than 90 cm for the practical treatment of a commercial cloth) uniformly, to permeate the treating liquid up to the core part of the cloth sufficiently and effectively, and thus to produce a uniform and excellent product effectively.

EXAMPLE 2

Figure 4:
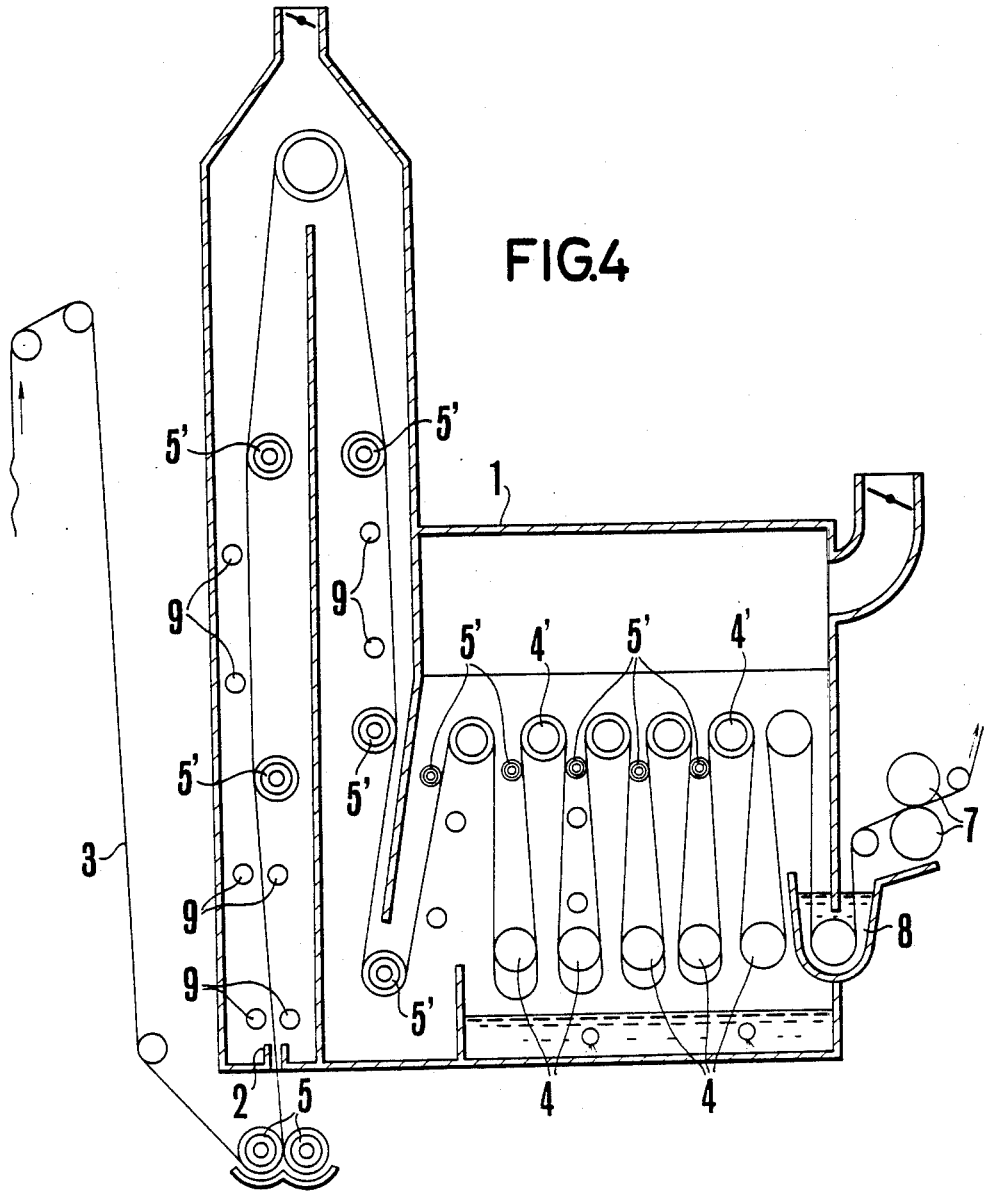
FIG. 4 is a sectional side view of another example of the wet-heat treating chamber.

Another example of the wet-heat treating chamber in the present invention is as shown in FIG. 4. The high temperature liquid generating mechanism to be used in this example of the apparatus is the same as in FIG. 3. In this example, the treating liquid is applied to the cloth 3 outside of the wet-heat treating chamber with the use of a pair of liquid applying rollers 5 with the construction similar to the liquid applying rollers 5 in Example 1 as shown in FIG. 2. The liquid applying rollers 5' provided in the wet-heat treating chamber 1 are used for the application of hot water.

What is characterized in this example is to provide a plurality of heaters 9 in the wet-heat treating chamber 1 for heating the cloth soaked with the treating liquid uniformly prior to the application of hot water to the resultant cloth with the use of the liquid applying rollers 5'. The heater 9 can be, for instance, an oil heater and an electric heater. Other constructions of the wet-heat treating chamber 1 as well as the high temperature liquid generating mechanism 11 are the same as in Example 1.

The continuous wet-heat treatment of a cloth by using the apparatus in this example is characterized in that a cloth soaked with a treating liquid uniformly with the use of the inventive liquid applying rollers 5 outside of steamer body is heat treated with the use of heaters 9 prior to the application of hot water to the resultant cloth with the use of liquid applying rollers 5' in the wet-heat treating chamber 1. Due to the effect of heating, the treating liquid permeates up to the core part of the cloth more effectively, and the wet-heat treatment of a cloth can be done more efficiently and uniformly to give an excellent and uniform product.

EXAMPLE 3

Figure 5:
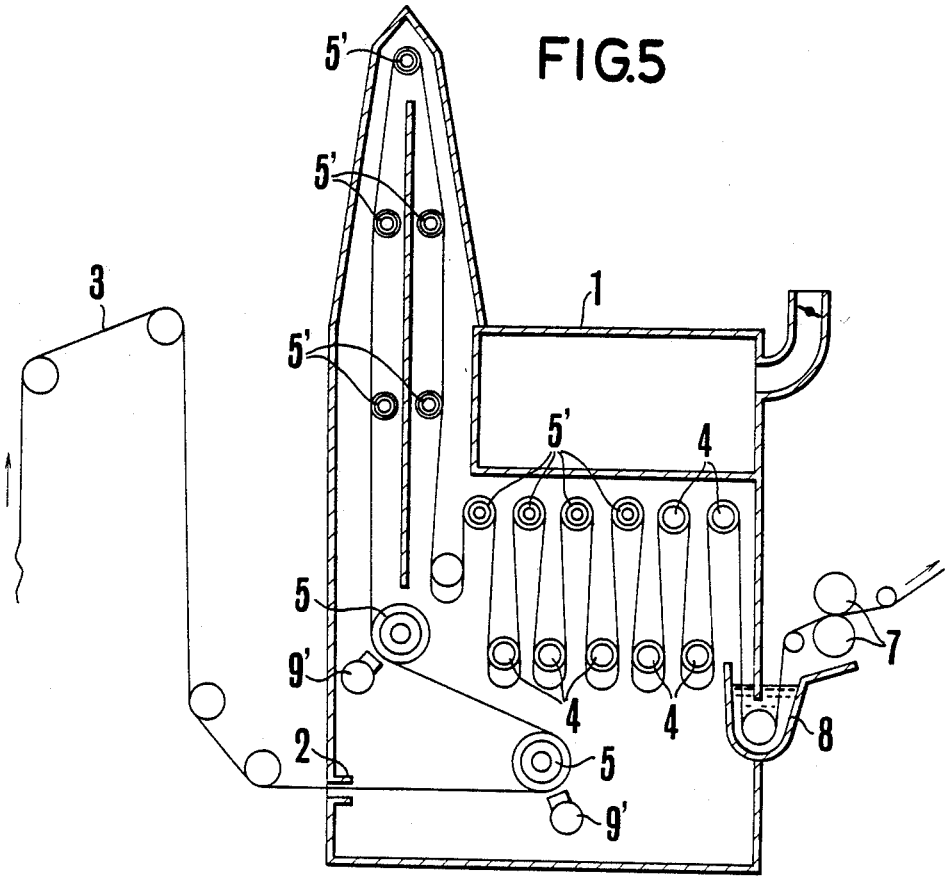
FIG. 5 is to show a further example of the wet-heat treating chamber.

A further example of the wet-heat treating chamber in the present invention is as shown in FIG. 5. The high temperature liquid generating mechanism to be used in this example of the apparatus is also the same as in Example 1. In this example, the treating liquid is applied to the cloth 3 with the use of the inventive liquid applying rollers 5 inside of the wet-heat treating chamber, and far infrared burners 9' are provided in the wet-heat treating chamber 1 for heating the cloth soaked with the treating liquid uniformly prior to the application of hot water to the resultant cloth with the use of the liquid applying rollers 5'.

In this example, particularly, the use of far infrared burner is quite effective to heat the cloth soaked with the treating liquid for permeating the treating liquid up to the core part of the cloth efficiently and uniformly, and accordingly, an excellent and uniform product can easily be obtained.

As described in detail in the above, the present invention is to provide a plurality of liquid applying rollers having numerous irregular, curved and bent communicating pores allover its periphery in contact with a cloth running continuously for applying a treating liquid and/or water to the cloth in a non-tightly sealed wet-heat treating chamber, and it is desirable to provide further a heater for heating the cloth soaked with the treating liquid uniformly in the wet-heat treating chamber. The treatment of a cloth such as scouring, bleaching, weight reduction and dyeing can be done uniformly up to the core part thereof uniformly and effectively to give an excellent product. Moreover, the present inventive apparatus is simple in its structure, and the treatment can be done with a limited amount of treating liquid and water resource economically. Further, the process is fitted for mass-production, and its merit is quite distinguished.

What we claim:

1. An apparatus for continuous wet-heat treatment of a cloth, comprising a non-tightly sealed wet-heat treating chamber provided with a plurality of liquid applying rollers for applying a treating liquid such as a treating liquid and/or water to a cloth running continuously through the wet-heat treating chamber, said liquid applying rollers being provided with numerous irregular, curved and bent communicating pores allover its periphery, and a high temperature liquid generating mechanism for generating a superheated treating liquid, said high temperature liquid generating mechanism being provided with a treating liquid heating pipe and/or a water heating pipe communicating to said liquid applying rollers.

2. An apparatus according to claim 1, in which a number of heaters are provided in the wet-heat treating chamber for heating the cloth soaked with the treating liquid further therewith.

3. An apparatus according to claim 2, in which the heaters comprise far infrared burners.

* * * * *